US008136501B2

(12) United States Patent
Kono et al.

(10) Patent No.: US 8,136,501 B2
(45) Date of Patent: Mar. 20, 2012

(54) VARIABLE STROKE ENGINE

(75) Inventors: Shohei Kono, Wako (JP); Sei Watanabe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 759 days.

(21) Appl. No.: 12/247,598

(22) Filed: Oct. 8, 2008

(65) Prior Publication Data

US 2009/0095261 A1 Apr. 16, 2009

(30) Foreign Application Priority Data

Oct. 11, 2007 (JP) ..... 2007-265675

(51) Int. Cl.
*F02B 75/32* (2006.01)

(52) U.S. Cl. ..... 123/197.1; 123/48 A; 123/48 R

(58) Field of Classification Search ..... 123/184.36, 123/184.61, 337, 184.55, 184.21, 184.42, 123/184.51
See application file for complete search history.

(56) References Cited

U.S. PATENT DOCUMENTS

| | | | | |
|---|---|---|---|---|
| 6,170,443 | B1 * | 1/2001 | Hofbauer | 123/51 B |
| 6,622,670 | B2 * | 9/2003 | Hiyoshi et al. | 123/48 B |
| 6,820,586 | B2 * | 11/2004 | Watanabe | 123/197.1 |
| 6,857,401 | B1 * | 2/2005 | Styron | 123/48 B |
| 2002/0144665 | A1 * | 10/2002 | Ushijima et al. | 123/48 B |
| 2003/0230257 | A1 * | 12/2003 | Watanabe | 123/48 B |

FOREIGN PATENT DOCUMENTS

| | | | |
|---|---|---|---|
| EP | 1347159 | A2 | 9/2003 |
| JP | 11-303941 | A | 11/1999 |
| JP | 2003-184566 | A | 7/2003 |
| JP | 2003-278567 | A | 10/2003 |
| JP | 2003-314237 | A | 11/2003 |

OTHER PUBLICATIONS

European Search Report having the date of completion of the search as Oct. 2, 2008, issued in corresponding European Patent Application No. EP 08016233.

Japanese Office Action dated Jul. 20, 2011, issued in corresponding Japanese Patent Application No. 2007-265675.

* cited by examiner

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

A variable stroke engine includes an end portion of a connecting rod, which is connected at one end portion thereof to a piston by a piston pin, and an end portion of a control rod, which is connected at one end portion thereof to an eccentric shaft, and which are linked to each other by a link member rotatably supported on a crankshaft. A rotative power of the crankshaft is transmitted to the camshaft. The camshaft is disposed at such a position that part of a trajectory drawn by the intake-side and exhaust-side cams overlaps a trajectory drawn by the link member in a projection on a plane perpendicular to an axis of the crankshaft, and a rotational phase of the camshaft is set so that the interference, of the intake-side and exhaust-side cams with an end portion, on the camshaft side, of the link member, is avoided.

1 Claim, 10 Drawing Sheets

VARIABLE STROKE ENGINE

TECHNICAL FIELD

The present invention relates to a variable stroke engine, more particularly, an improvement of a variable stroke engine in which a crankshaft; a camshaft constituting a part of a valve-operating system, and having an intake-side cam and an exhaust-side cam provided thereon; and a rotational shaft having an eccentric shaft, are rotatably supported in a crankcase of an engine body so as to have axes parallel to one another, a connecting rod is connected, at one end portion thereof, to a piston by a piston pin, a control rod is connected, at one end portion thereof, to the eccentric shaft, the other end portion of the connecting rod and the other end portion of the control rod are linked to each other by a link member rotatably supported on the crankshaft, and a rotative power of the crankshaft is transmitted to the camshaft.

BACKGROUND OF THE INVENTION

Such variable stroke engine has already been known as disclosed in Japanese Patent Application Laid-open No. 2003-278567.

However, in the variable stroke engine disclosed in Japanese Patent Application Laid-open No. 2003-278567, the camshaft is disposed at a position relatively spaced apart from the crankshaft for the purpose of avoiding the interference between the end portion, on the camshaft side, of the link member and the intake-side or exhaust-side cam. For this reason, the size of the crankcase, and further, the size of the entire engine is increased.

SUMMARY OF THE INVENTION

The present invention has been made in view of the above-described circumstance. It is an object of the present invention to provide a variable stroke engine having a camshaft disposed at a position close to a crankshaft side, and thus being capable of reducing the size of the engine.

In order to achieve the object, according to a first feature of the present invention, there is provided a variable stroke engine in which a crankshaft; a camshaft constituting a part of a valve-operating system, and having an intake-side cam and an exhaust-side cam provided thereon; and a rotational shaft having an eccentric shaft, are rotatably supported in a crankcase of an engine body so as to have axes parallel to one another, a connecting rod is connected, at one end portion thereof, to a piston by a piston pin, a control rod is connected, at one end portion thereof, to the eccentric shaft, the other end portion of the connecting rod and the other end portion of the control rod are linked to each other by a link member rotatably supported on the crankshaft, and a rotative power of the crankshaft is transmitted to the camshaft, wherein the camshaft is disposed at such a position that part of a trajectory drawn by the intake-side and exhaust-side cams overlaps a trajectory drawn by the link member in a projection on a plane perpendicular to an axis of the crankshaft, and a rotational phase of the camshaft is set so that the interference of the intake-side and exhaust-side cams with an end portion, on the camshaft side, of the link member is avoided.

With the first feature, the camshaft is disposed at such position that part of the trajectory drawn by the intake-side and exhaust-side cams overlaps the trajectory drawn by the link member in the projection on a plane perpendicular to the axis of the crankshaft, while the interference of the intake-side and exhaust-side cams with the end portion, on the camshaft side, of the link member is avoided. This configuration makes it possible to dispose the camshaft at a position close to the crankshaft side. As a result, the size of the engine can be reduced.

According to a second feature of the present invention, in addition to the first feature, the camshaft and the rotational shaft are disposed on the same side of a plane defined by a cylinder axis and the crankshaft axis.

With the second feature, as noted above, the camshaft and the rotational shaft are disposed on the same side of a plane defined by the cylinder axis and the crankshaft axis. Accordingly, it is possible to dispose the camshaft at a position close to the rotational shaft side while avoiding the interference of the camshaft with the trajectory of the link member. As a result, the entire engine can be made compact.

Hereinafter, embodiments of the present invention will be described with reference to examples of the present invention which are shown in the accompanying drawings.

BRIEF DESCRIPTION OF THE DRAWINGS

FIG. 1 is a vertical cross-sectional view showing an engine in a state where a piston is positioned immediately before an exhaust top dead center, and is a cross-sectional view taken along a line 1-1 in FIG. 2.

FIG. 2 is a cross-sectional view taken along a line 2-2 in FIG. 1.

FIG. 3 is a vertical cross-sectional view corresponding to FIG. 1, and showing the engine in a state where the piston is positioned at an expansion bottom dead center.

FIG. 4 is a vertical cross-sectional view corresponding to FIG. 1, and showing the engine in a state where the piston is moved upward from the state shown in FIG. 3.

FIG. 5 is a vertical cross-sectional view corresponding to FIG. 1, and showing the engine in a state where the piston is moved upward from the state shown in FIG. 4.

FIG. 6 is a vertical cross-sectional view corresponding to FIG. 1, and showing the engine in a state where the piston is moved upward from the state shown in FIG. 5.

DETAILED DESCRIPTION OF THE INVENTION

Figure 1:
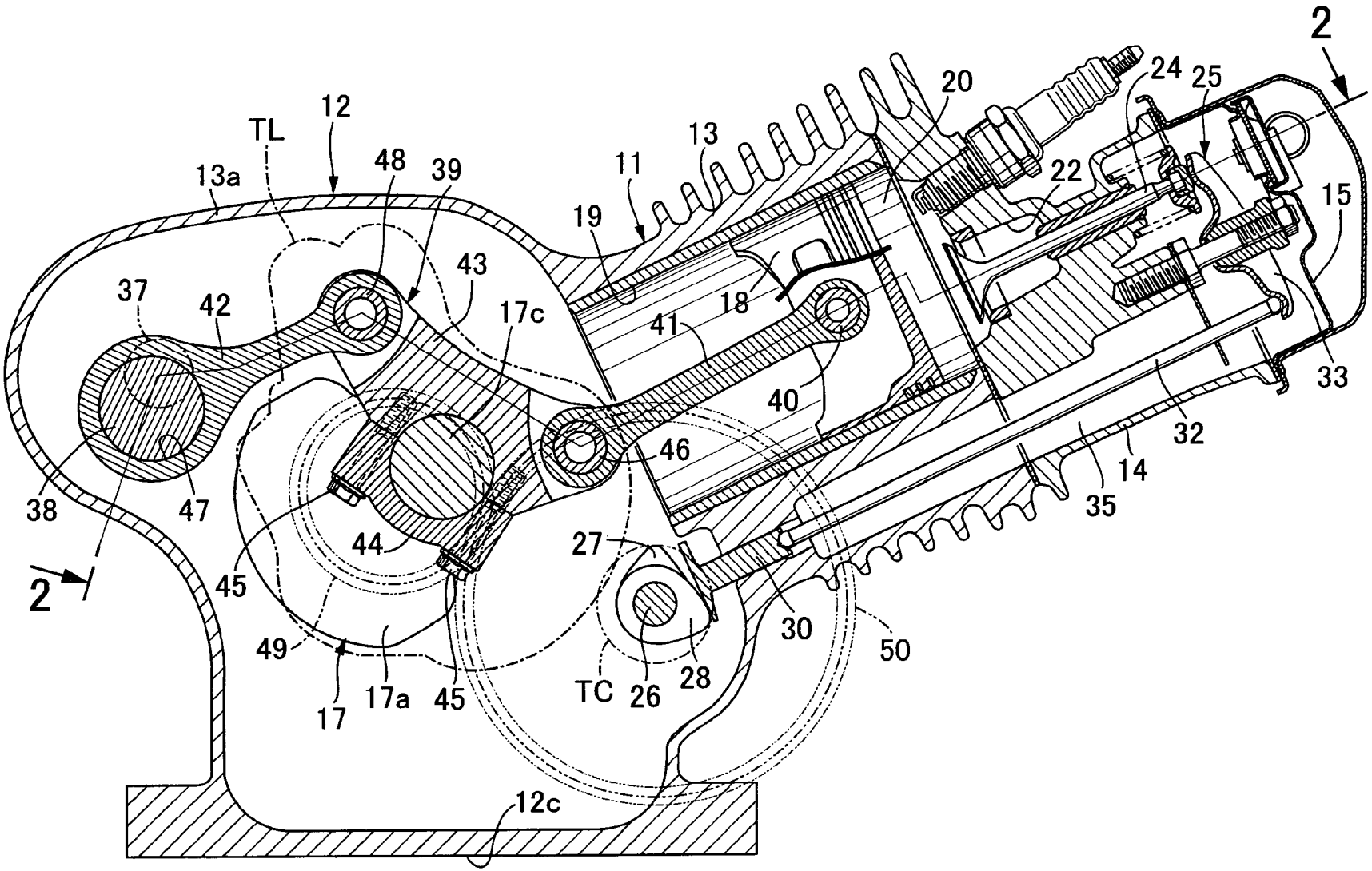
FIG. 1 to FIG. 6 show a first embodiment of the present invention.
Figure 2:
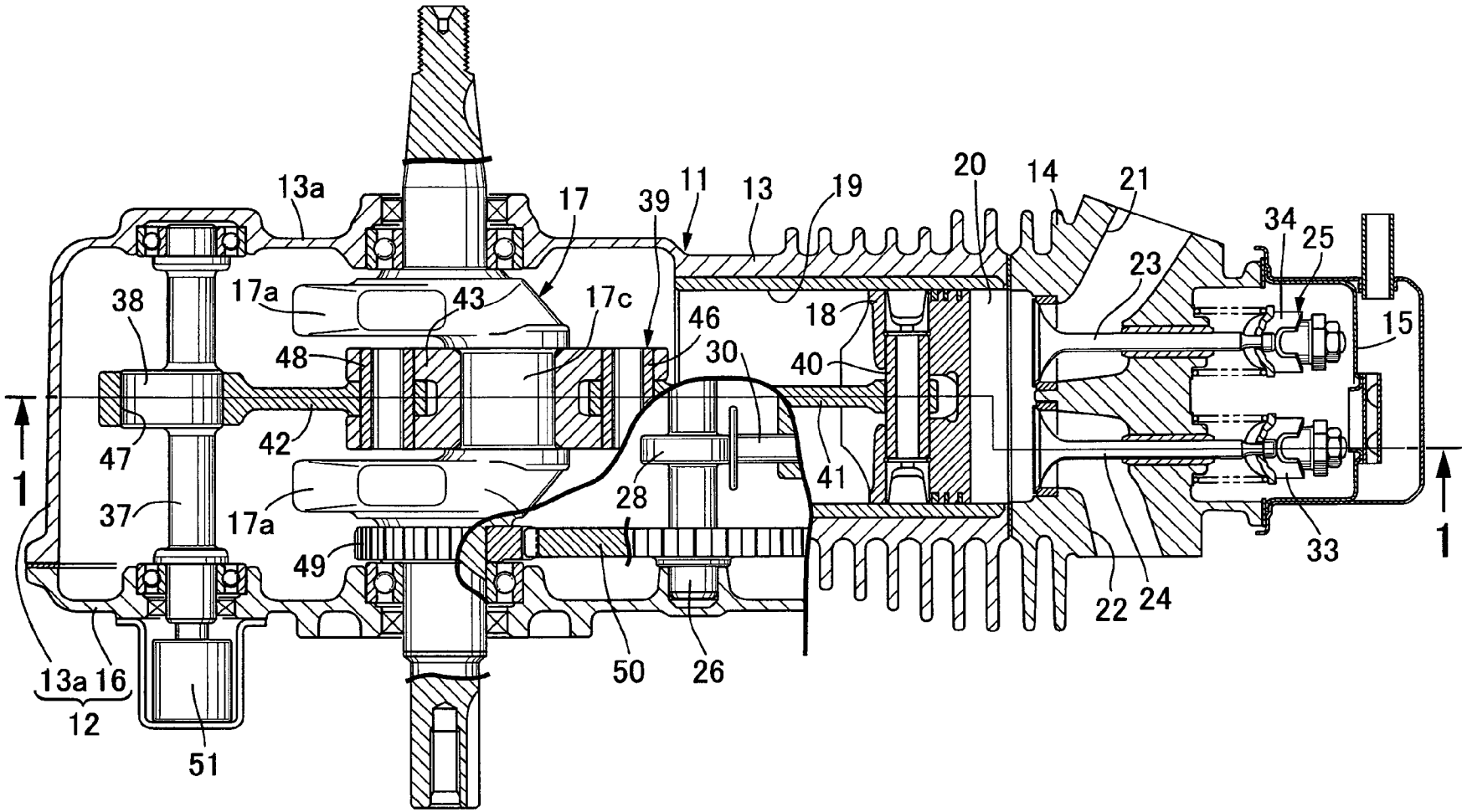

First, referring to FIG. 1 and FIG. 2, this engine is an air-cooled single cylinder engine, which is used for working machines and the like, for example. An engine body 11 includes: a crankcase 12; a cylinder block 13 protruding upward from the crankcase 12; a cylinder head 14 joined to a head portion of the cylinder block 13; and a head cover 15 connected to the cylinder head 14. The crankcase 12 is mounted on engine heads of various operating machines, at a mounting face 12*a* on the lower surface of the crankcase 12.

The crankcase 12 includes a case main body 13*a* formed integrally with the cylinder block 13, and a side cover 16 joined to the case main body 13*a*. A crankshaft 17 is rotatably supported in the crankcase 12. The crankshaft 17 integrally has a pair of balance weights 17*a* and 17*b*, as well as a crank pin 17*c* which connects between the balance weights 17*a* and 17*b*.

A cylinder bore 19 is formed in the cylinder block 13. A piston 18 is slidably fitted in the cylinder bore 19. A combustion chamber 20 is formed between the cylinder block 13 and the cylinder head 14, and a top portion of the piston 18 faces the combustion chamber 20. An intake port 21 and an exhaust port 22, both communicating with the combustion chamber 20, are formed in the cylinder head 14. In addition, an intake valve 23 for opening and closing the passage between the intake port 21 and the combustion chamber 20 as well as an exhaust valve 24 for opening and closing the passage between the exhaust port 22 and the combustion chamber 20 are disposed in the cylinder head 14 so as to be capable of performing the opening and closing operations.

A valve-operating system 25 for driving the intake valve 23 and the exhaust valve 24 to be opened and closed includes a camshaft 26, an intake-side cam 27, an exhaust-side cam 28, an exhaust-side valve lifter 30, an intake-side valve lifter (not illustrated), an exhaust-side push rod 32, an intake-side push rod (not illustrated), an exhaust-side rocker arm 33, and an intake-side rocker arm 34. The camshaft 26 has an axis parallel to the crankshaft 17, and is rotatably supported in the crankcase 12. The intake-side and exhaust-side cams 27 and 28 are provided on the camshaft 26. The exhaust-side valve lifter 30 is operably supported in the cylinder block 13, and is in sliding contact with the exhaust-side cam 28. The intake-side valve lifter is operably supported in the cylinder block 13, and is in sliding contact with the intake-side cam 27, in the same manner as the exhaust-side valve lifter 30. The exhaust-side push rod 32 extends toward the head cover 15 while abutting, at the lower end thereof, on the exhaust-side valve lifter 30. The intake-side push rod extends toward the head cover 15 while abutting, at the lower end thereof, on the intake-side valve lifter, in the same manner as the exhaust-side push rod 32. The exhaust-side rocker arm 33 is swingably supported in the cylinder head 14 while abutting, at one end thereof, on the exhaust valve 24 spring-biased in its closing direction. The upper end of the exhaust-side push rod 32 abuts on the other end of the exhaust-side rocker arm 33. The intake-side rocker arm 34 is swingably supported in the cylinder head 14 while abutting, at one end thereof, on the intake valve 23 spring-biased in its closing direction. The upper end of the intake-side push rod abuts on the other end of the intake-side rocker arm 34.

An operating chamber 35 is formed in the cylinder block 13 and the cylinder head 14. The upper portions respectively of the intake-side valve lifter and exhaust-side valve lifter 30 protrude into the operating chamber 35 from the lower portion of the operating chamber 35. The intake-side push rod and the exhaust-side push rod 32 are disposed in the operating chamber 35.

A rotational shaft 37 having an eccentric shaft 38 is disposed on the opposite side of the axis of the crankshaft 17 from the camshaft 26. The rotational shaft 37 is rotatably supported in the crankcase 12 in a manner that the rotational shaft 37 is rotatable about its axis parallel to the crankshaft 17 and the camshaft 26.

A connecting rod 41 is connected, at one end portion thereof, to the piston 18*by* a piston pin 40, while a control rod 42 is connected, at one end portion thereof, to the eccentric shaft 38. The other end portions respectively of the connecting rod 41 and the control rod 42 are linked to each other by a link member 43 which is rotatably supported by the crank pin 17*c* of the crankshaft 17. The connecting rod 41, the link member 43, and the control rod 42 constitute a link mechanism 39.

The link member 43 is formed to be in sliding contact with a half of the circumference of the crank pin 17*c*. A crank cap 44 is in sliding contact with the remaining half of the circumference of the crank pin 17*c*, and is fastened to the link member 43 with bolts 45, 45.

The connecting rod 41 is rotatably connected, at the other end portion thereof, to one end portion of the link member 43 by a first pin 46. A circular shaft hole 47 is formed in the one end portion of the control rod 42, and the eccentric shaft 38 is fitted in the circular shaft hole 47 so as to be relatively slidable. The control rod 42 is rotatably connected, at the other end portion thereof, to the other end portion of the link member 43 by a second pin 48.

The rotative power of the crankshaft 17 is transmitted to the camshaft 26 while the rotational speed is reduced to a half. A driving gear 49 is mounted on the crankshaft 17, and arranged at a position to the outer side, in the axial direction, of the balance weight 17*b* of the crankshaft 17. In addition, a driven gear 50 meshing with the driving gear 49 is mounted on the camshaft 26. The driven gear 50 is formed to have an outside diameter which is twice as large as that of the driving gear 49.

On the other hand, an electric motor 51 fixedly disposed outside the crankcase 12 is coupled to one end of the rotational shaft 37. Accordingly, the position of the eccentric shaft 38, that is, the supporting point of the control rod 42 is displaced in association with the rotational shaft 37 rotated by the electric motor 51. The link mechanism 39 thereby operates in a manner that, for example, the stroke of the piston 18 in the expansion stroke becomes larger than that in the compression stroke. Thus, a higher expansion work is achieved with the same intake volume of the air-fuel mixture, so that the cycle thermal efficiency is improved.

Meanwhile, the link member 43 of the link mechanism 39 draws a trajectory TL, which is indicated by a dot-dash line in FIG. 1, in a projection on a plane perpendicular to the axis of the crankshaft 17. The intake-side cam 27 and the exhaust-side cam 28, which are provided on the camshaft 26, draw a trajectory TC, which is indicated by another dot-dash line in FIG. 1, in the projection. The camshaft 26 is disposed at such a position that part of the trajectory TC overlaps the trajectory TL.

Figure 3:
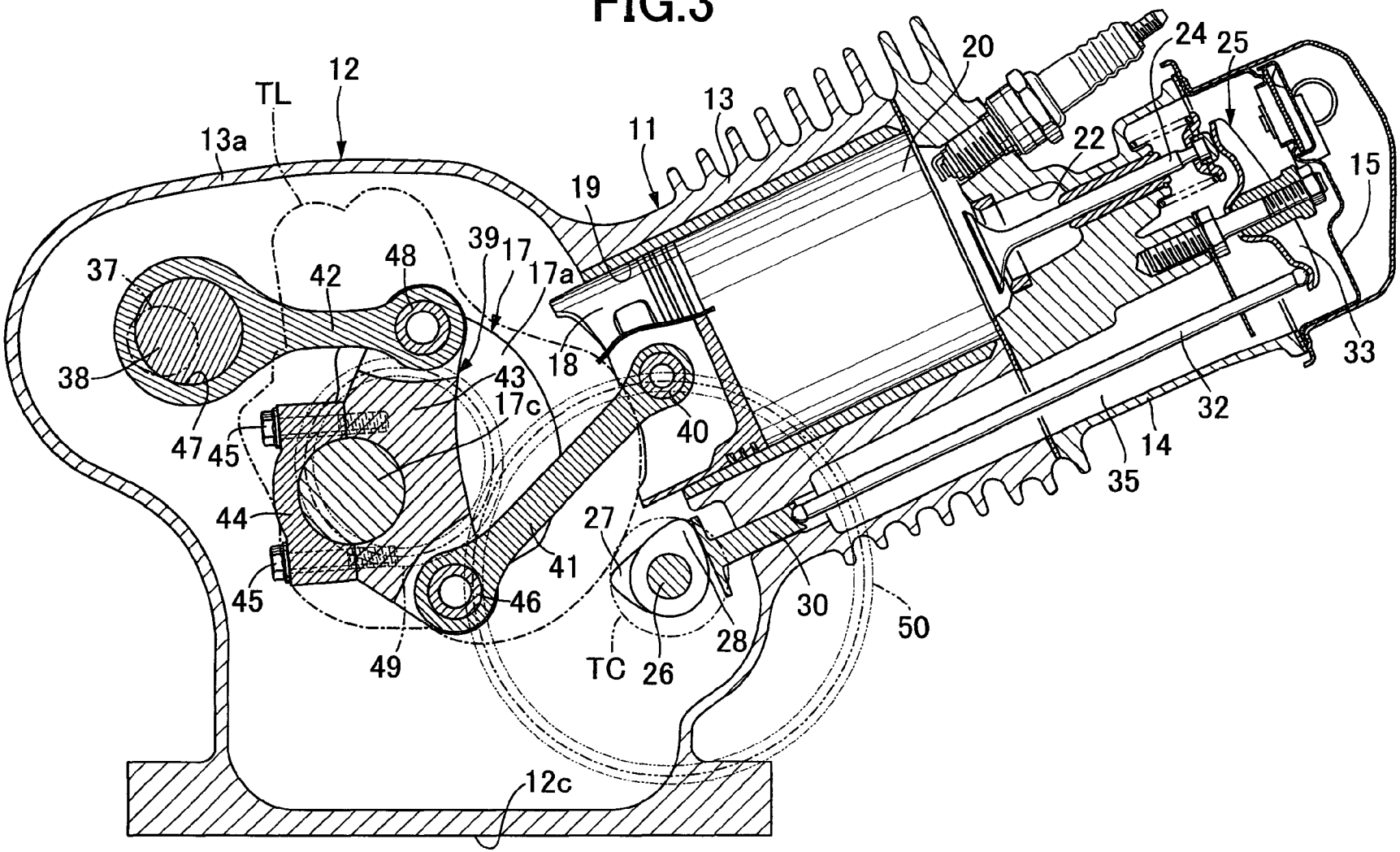
Figure 4:
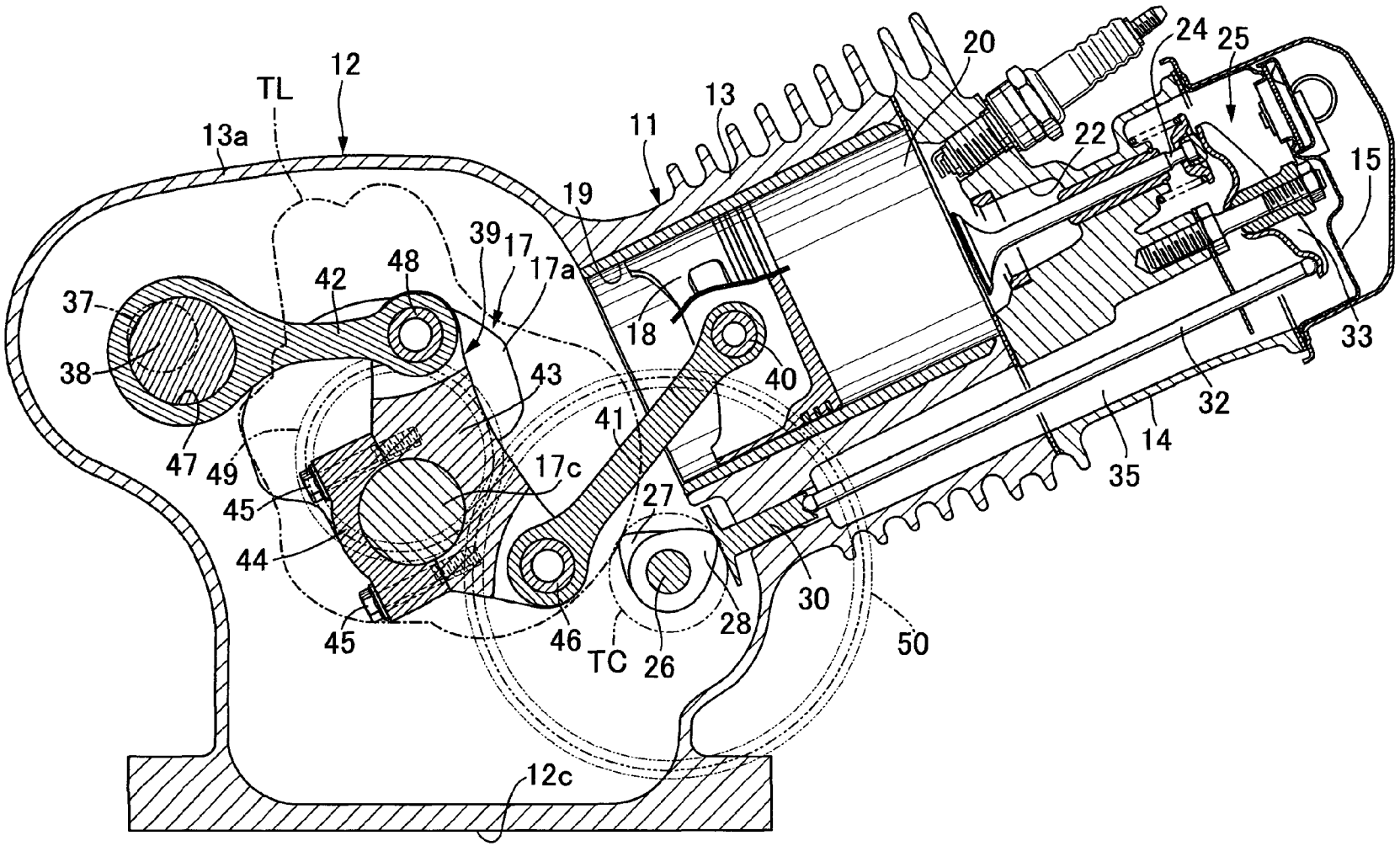
Figure 5:
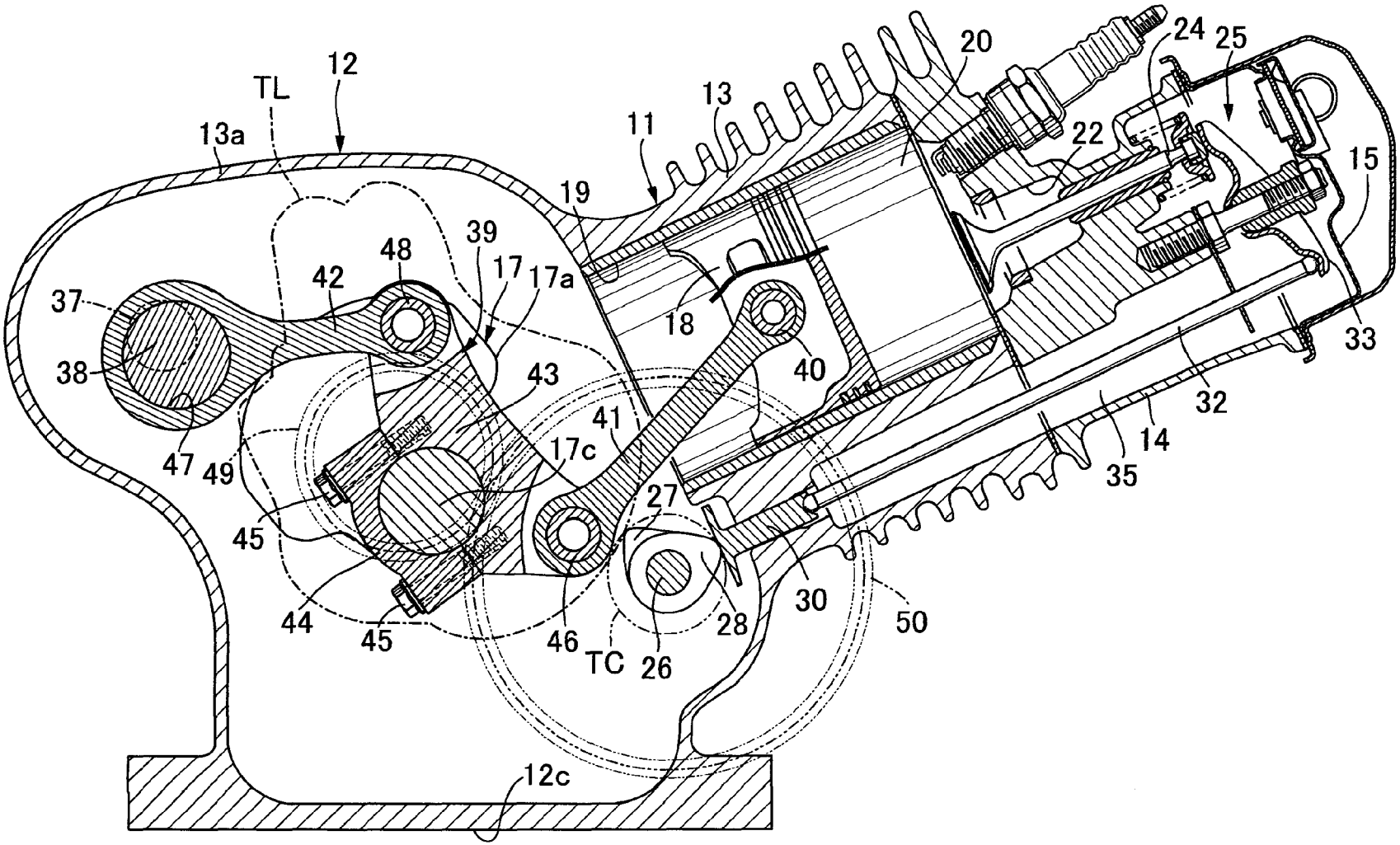
Figure 6:
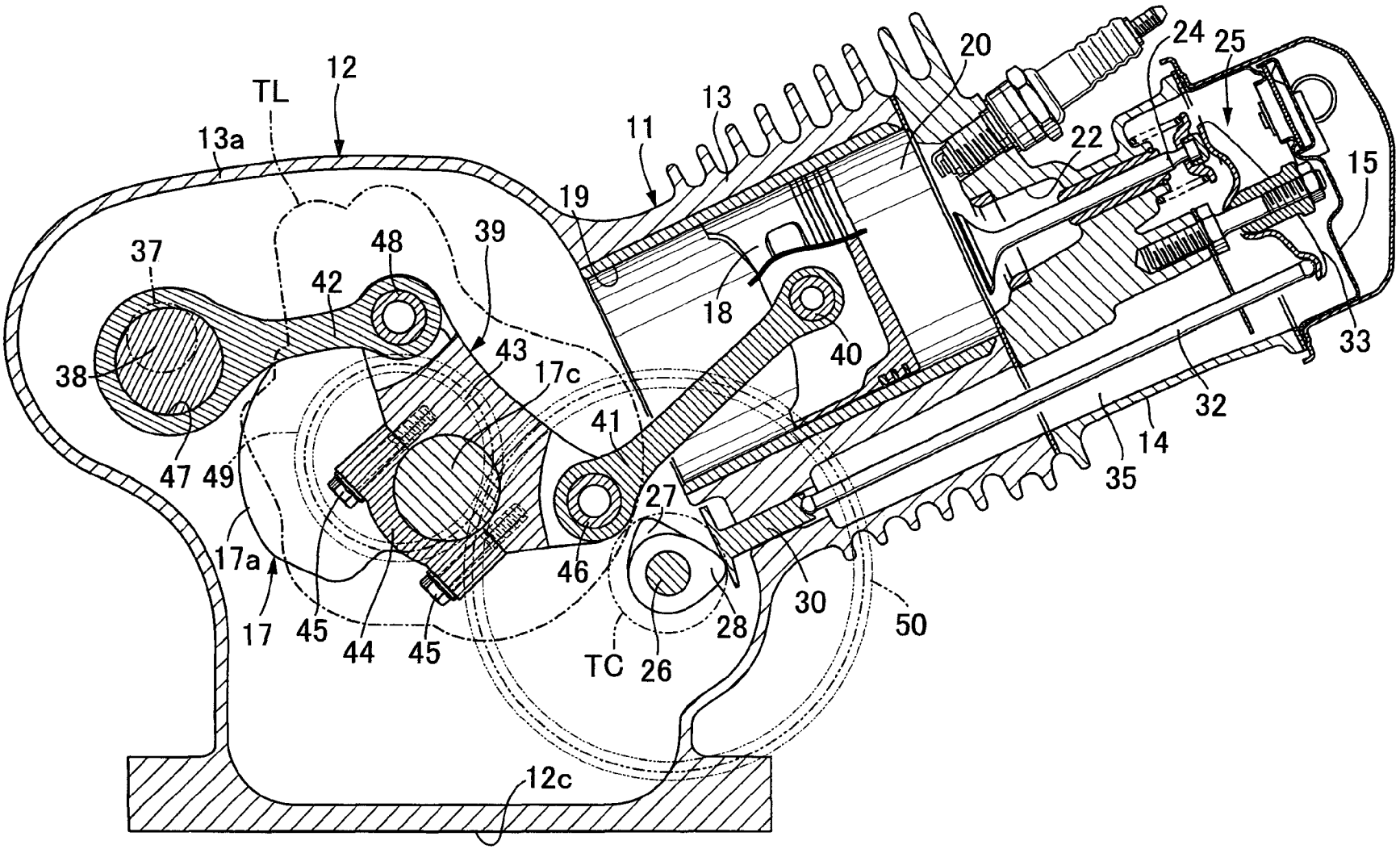

Moreover, the rotational phase of the camshaft 26 is set so that the interference of the intake-side and exhaust-side cams 27 and 28 with an end portion, on the camshaft 26 side, of the link member 43 is avoided. Now, observing a change in the course of the ascending of the piston 18 from an expansion bottom dead center to an exhaust top dead center, the intake-side cam 27 does not interfere with the end portion, on the camshaft 26 side, of the link member 43, during the movement of the piston 18 from the expansion bottom dead center shown in FIG. 3, to the position immediately before the exhaust top dead center shown in FIG. 1, through the states shown respectively in FIGS. 4, 5, and 6. Also during the movement of the piston 18 other than the ascending stroke of the piston 18 from the expansion bottom dead center to the position immediately before the exhaust top dead center, the intake-side cam 27 and the exhaust-side cam 28 do not interfere with the end portion, on the camshaft 26 side, of the link member 43.

Next, the operation of the first embodiment will be described. The camshaft 26 is disposed at such position that part of the trajectory TC drawn by the intake-side and exhaust-side cams 27 and 28 overlaps the trajectory TL drawn by the link member 43 in the projection on the plane perpendicular to the axis of the crankshaft 17, while the interference of the intake-side and exhaust-side cams 27 and 28 with the end portion, on the camshaft 26 side, of the link member 43 is avoided. This configuration makes it possible to dispose the camshaft 26 at a position close to the crankshaft 17 side, and to reduce the size of the engine.

FIG. 7 to FIG. 10 show the second embodiment of the present invention.

Parts corresponding to those in the first embodiment are only shown in FIG. 7 to 10 with the same reference numerals, and are not described in detail.

In the first embodiment, the camshaft 26 is disposed on the opposite side of the axis of the camshaft 17 from the rotational shaft 37. In the second embodiment, the camshaft 26 and the rotational shaft 37 are disposed on the same side of a plane defined by cylinder axis C and the axis of the crankshaft 17. In conjunction with this structure, the intake-side valve lifter, the exhaust-side valve lifter 30, the intake-side push rod, and the exhaust-side push rod 32 in the valve-operating system 25 are disposed on the opposite side from those in the first embodiment.

Figure 7:
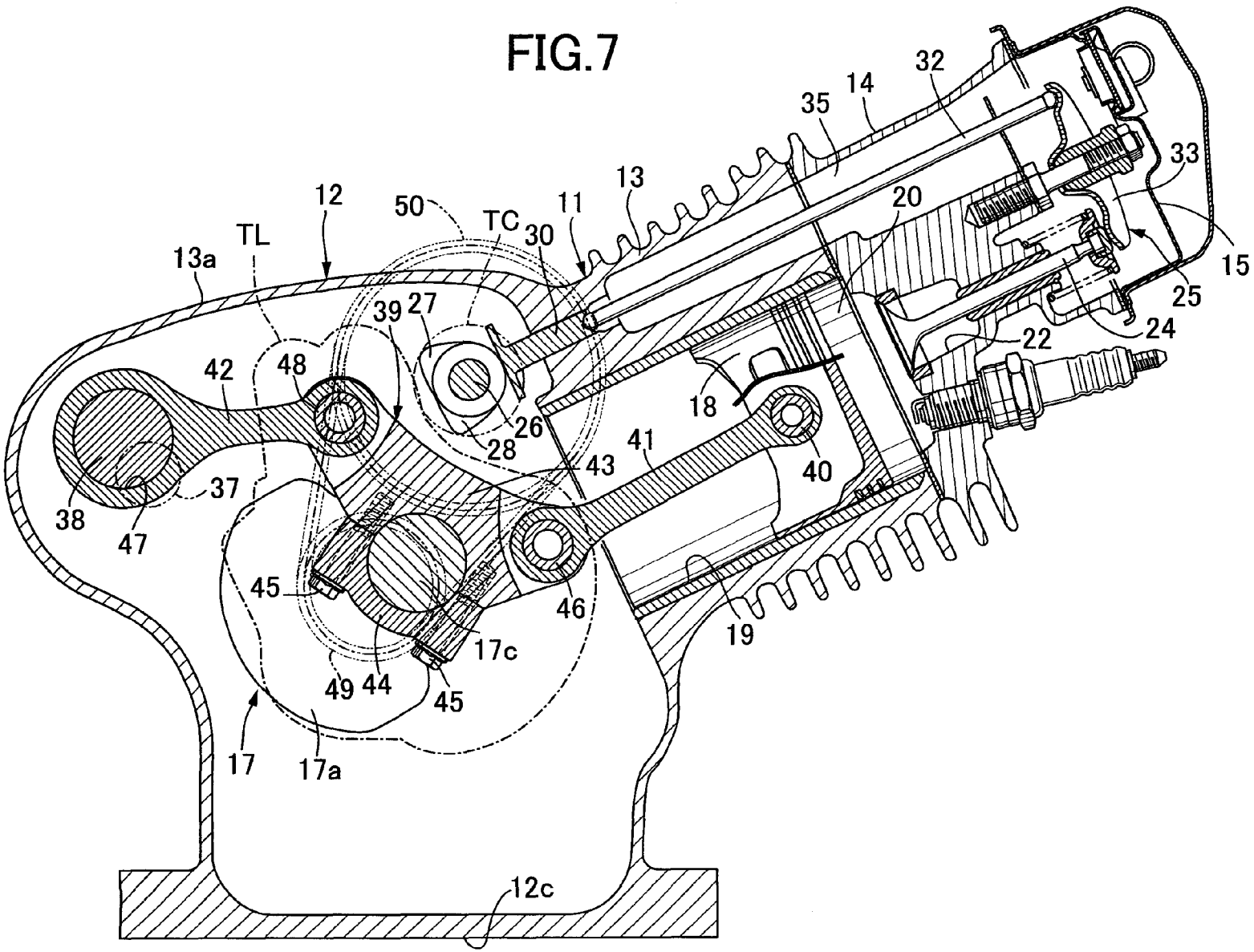
FIG. 7 shows a second embodiment of the present invention, and is a vertical cross-sectional view corresponding to FIG. 1, and showing an engine in a state where a piston is positioned immediately before the exhaust top dead center.
Figure 8:
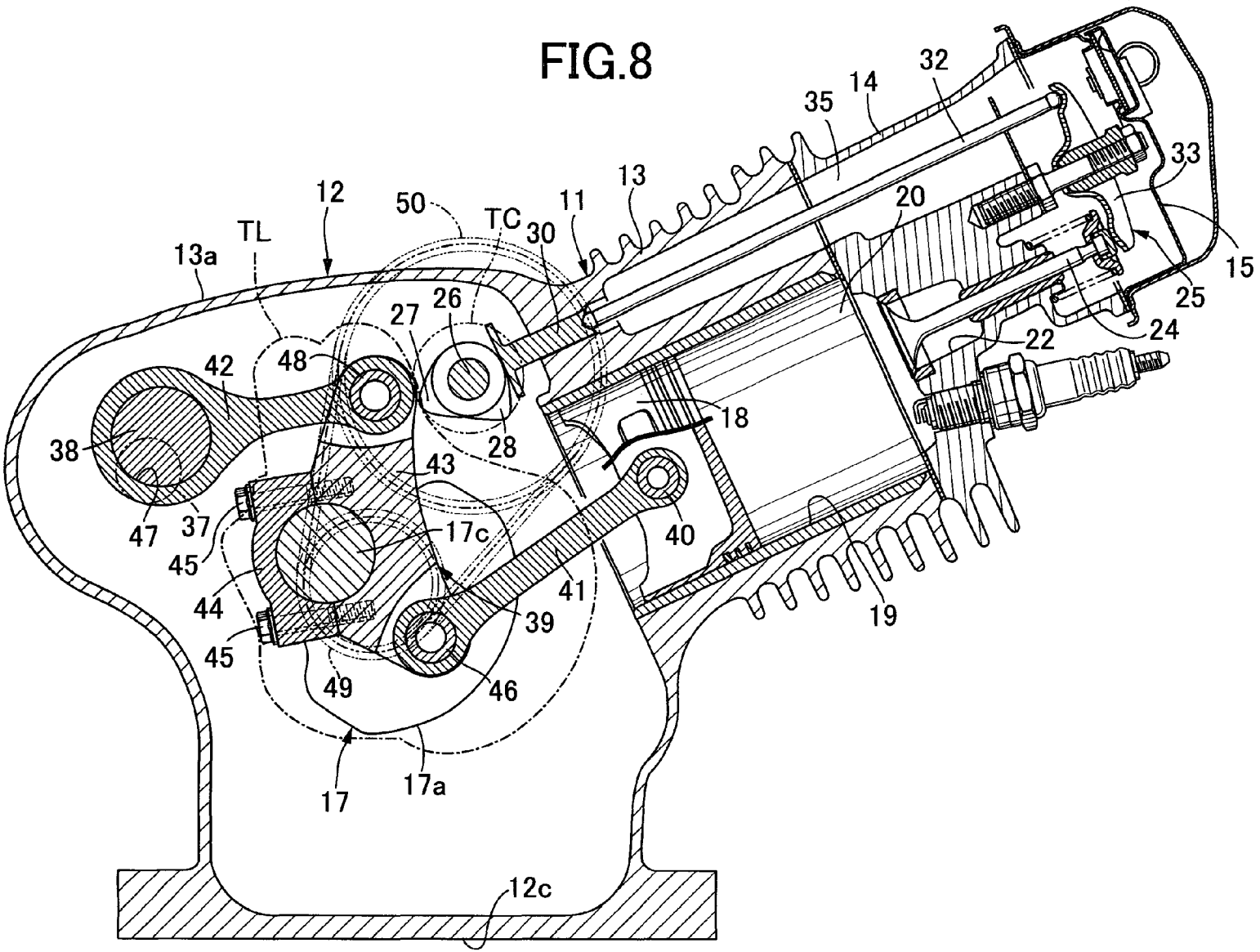
FIG. 8 is a vertical cross-sectional view corresponding to FIG. 7, and showing the engine in a state where the piston is in an expansion stroke.
Figure 9:
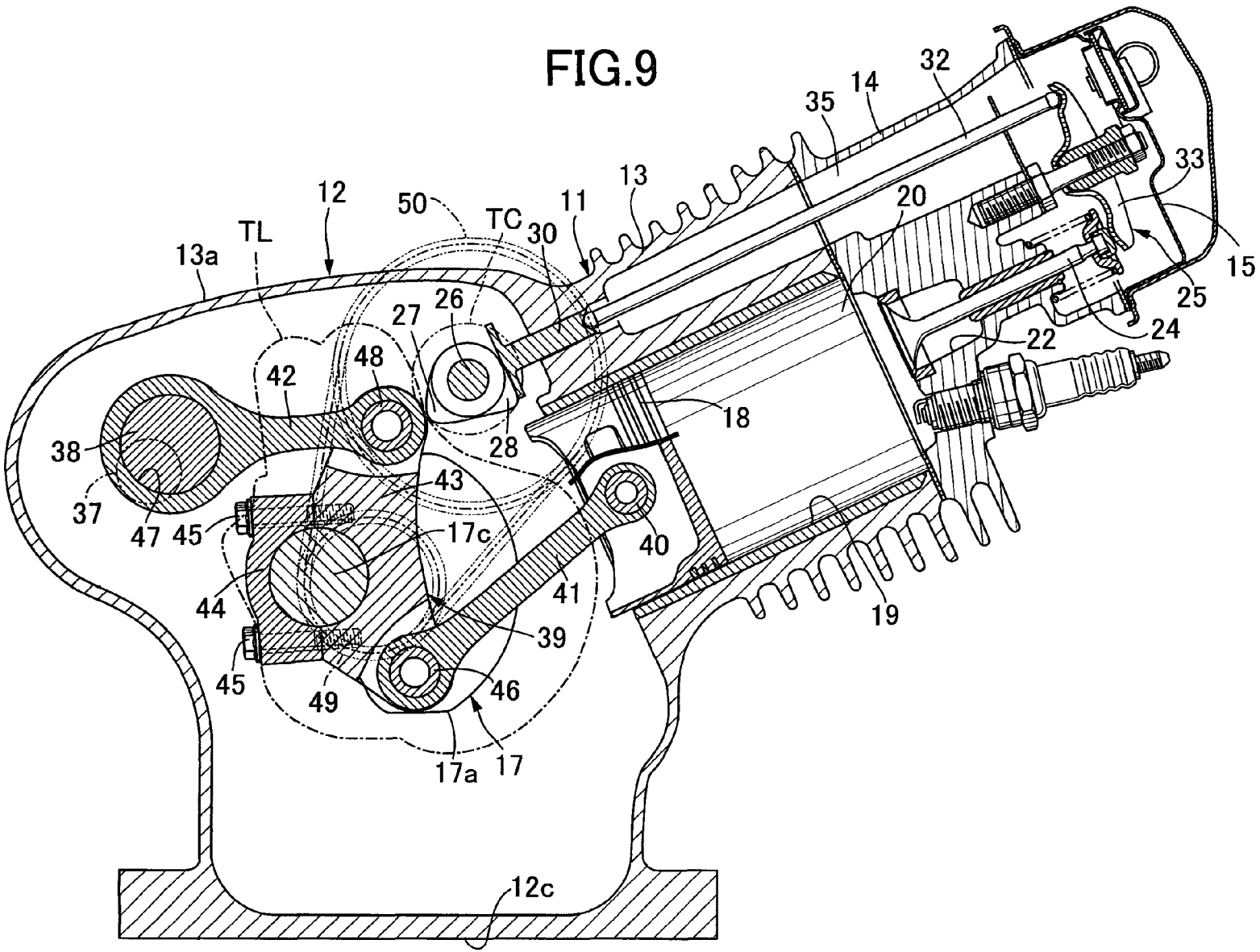
FIG. 9 is a vertical cross-sectional view corresponding to FIG. 7, and showing the engine in a state where the piston is moved downward from the state shown in FIG. 8.
Figure 10:
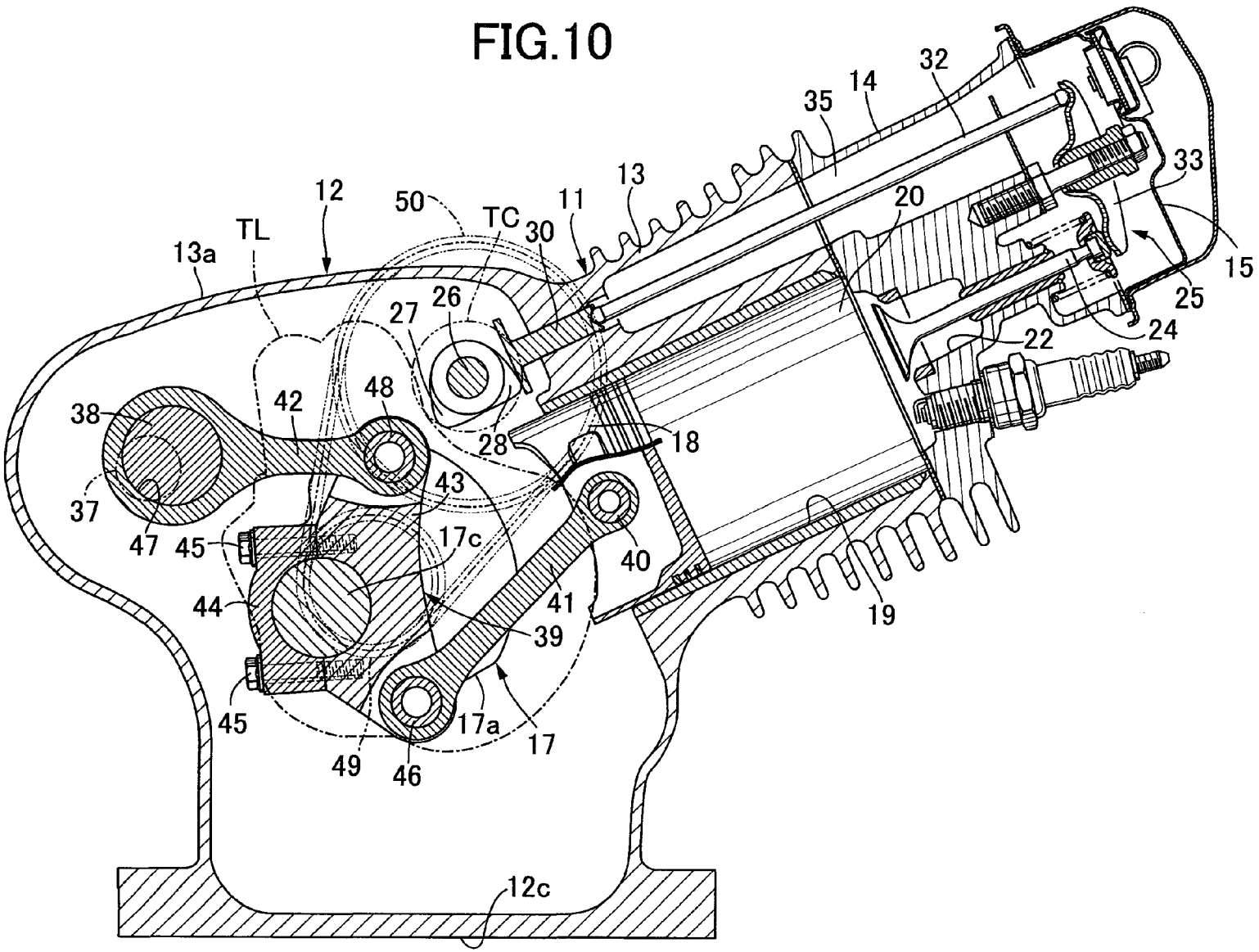
FIG. 10 is a vertical cross-sectional view corresponding to FIG. 7, and showing the engine in a state where the piston is positioned at the expansion bottom dead center.

In the second embodiment as well, the link member 43 draws a trajectory TL, which is indicated by a dot-dash line in FIG. 7, in a projection on a plane perpendicular to the axis of the crankshaft 17, while the intake-side cam 27 and the exhaust-side cam 28, which are provided on the camshaft 26, draw a trajectory TC, which is indicated by another dot-dash line in FIG. 7, in the projection. The camshaft 26 is disposed at such a position that part of the trajectory TC overlaps the trajectory TL.

Moreover, the rotational phase of the camshaft 26 is set so that the interference of the intake-side and exhaust-side cams 27 and 28 with an end portion, on the camshaft 26 side, of the link member 43 is avoided. Now, observing a change in the course of the descending of the piston 18 to the expansion bottom dead center in the expansion stroke, the exhaust-side cam 28 does not interfere with the end portion, on the camshaft 26 side, of the link member 43, during the movement of the piston 18 from the position in the middle of the expansion stroke shown in FIG. 8, to the expansion bottom dead center shown in FIG. 10, through the state shown in FIG. 9. Also during the movement of the piston 18 other than the expansion stroke of the piston 18, the intake-side cam 27 and the exhaust-side cam 28 do not interfere with the end portion, on the camshaft 26 side, of the link member 43.

According to the second embodiment, it is possible to dispose the camshaft 26 at a position close to the crankshaft 17 side, and also to dispose the camshaft 26 at a position close to the rotational shaft 37 side while avoiding the interference of the camshaft 26 with the link member 43. As a result, the entire engine can be made more compact.

Although the embodiments of the present invention have been described so far, the present invention is not limited to those embodiments, and various modifications in design may be made without departing from the present invention described in the scope of claims.

We claim:

1. A variable stroke engine, comprising:

a crankshaft, a camshaft constituting a part of a valve-operating system, and having an intake-side cam and an exhaust-side cam provided thereon;

a rotational shaft having an eccentric shaft, wherein said crankshaft, said camshaft and said rotational shaft are rotatably supported in a crankcase of an engine body so as to have axes parallel to one another;

a connecting rod connected, at one end portion thereof, to a piston by a piston pin;

a control rod connected, at one end portion thereof, to said eccentric shaft; and a second end portion of said connecting rod and a second end portion of said control rod being linked to each other by a link member, rotatably supported by a crank pin of said crankshaft, wherein a rotative power of said crankshaft is transmitted to said camshaft, wherein said intake-side and exhaust-side cams are disposed at the same position of a part of said link member in a direction along an axis of said crankshaft, said camshaft and said rotational shaft are disposed on a same side with respect to a cylinder axis in a projection on a plane perpendicular to the axis of said crankshaft, a trajectory drawn by said link member on said projection plane is set so that a curved line dented toward a side opposite to said intake-side and exhaust side cams is formed at a part, of its trajectory, facing said cams, said camshaft is disposed at such a position that part of a trajectory drawn by said intake-side and exhaust-side cams overlaps said curved line of said trajectory drawn by said link member on said projection plane, and a rotational phase of said camshaft is set so that an interference, of said intake-side and exhaust-side cams with an end portion, on the camshaft side, of said link member, is avoided.

* * * * *